United States Patent [19]

Hadjis

[11] Patent Number: 4,690,087

[45] Date of Patent: Sep. 1, 1987

[54] SYSTEM AND METHOD FOR RAISING SUNKEN VESSELS

[76] Inventor: Constantin Hadjis, Calle 84 No. 2A/14, Edificio El Cerro, Maracaibo(Zulia), Venezuela

[21] Appl. No.: 894,162

[22] Filed: Aug. 7, 1986

Related U.S. Application Data

[63] Continuation of Ser. No. 842,504, Mar. 21, 1986, abandoned, which is a continuation of Ser. No. 778,631, Sep. 20, 1985, abandoned, which is a continuation of Ser. No. 625,279, Jun. 27, 1984, abandoned.

[51] Int. Cl.[4] ..... B63C 7/06

[52] U.S. Cl. ..... 114/50

[58] Field of Search ..... 114/44, 50–55

[56] References Cited

U.S. PATENT DOCUMENTS

| | | | |
|---|---|---|---|
| 854,596 | 5/1907 | Oliver | 114/55 |
| 867,983 | 10/1907 | Lake | 114/50 |
| 1,544,650 | 7/1925 | Kiwull | 114/50 |
| 1,848,581 | 3/1932 | Stein | 114/50 |
| 1,863,732 | 6/1932 | Schwager | 114/54 |
| 2,363,488 | 11/1944 | Bartlett | 114/50 |
| 2,857,873 | 10/1958 | Norelli et al. | 114/50 |
| 3,269,342 | 8/1966 | Sobek | 114/50 |
| 3,605,671 | 9/1971 | Helbig | 114/50 |
| 3,822,660 | 7/1974 | Throner | 114/50 |

FOREIGN PATENT DOCUMENTS

| | | | |
|---|---|---|---|
| 18174 | of 1908 | United Kingdom | 114/50 |
| 2068299 | 8/1981 | United Kingdom | 114/50 |

*Primary Examiner*—Jeffrey V. Nase
*Assistant Examiner*—Stephen P. Avila
*Attorney, Agent, or Firm*—Paul J. Sutton

[57] ABSTRACT

A method and a system for raising a sunken vessel by positioning cryogenic piping around and within the sunken vessel so that an ice mass forms integral with the vessel and the vessel is raised to the surface of the water by action of the buoyancy of the ice mass.

14 Claims, 25 Drawing Figures

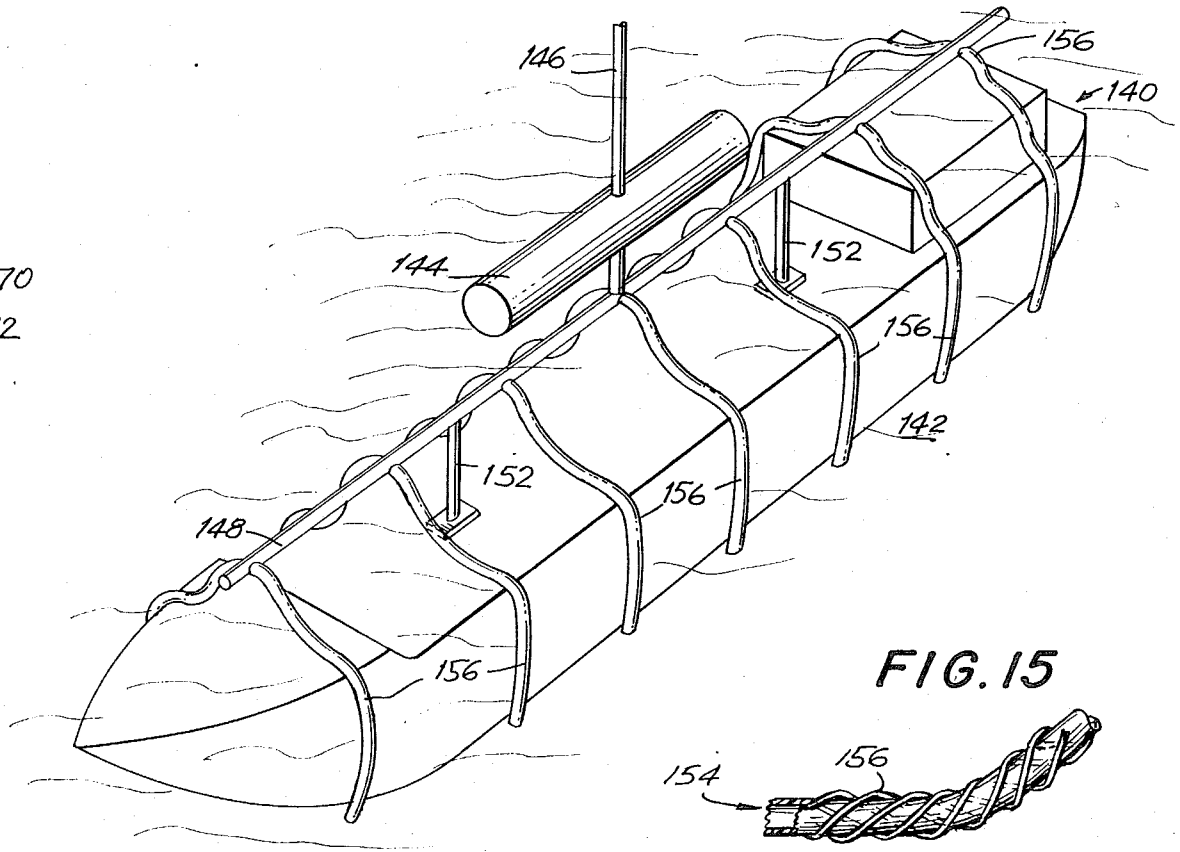
FIG. 14
FIG. 15
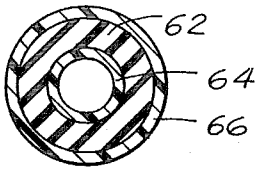
FIG. 11
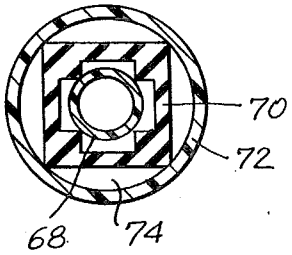
FIG. 12
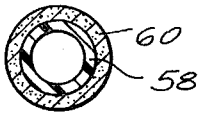
FIG. 10
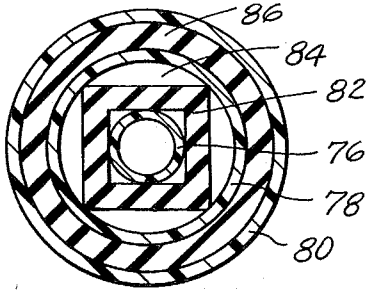
FIG. 13

SYSTEM AND METHOD FOR RAISING SUNKEN VESSELS

CROSS-REFERENCE TO RELATED APPLICATIONS

This application is a continuation of patent application Ser. No. 842,504, filed Mar. 21, 1986, now abandoned, which was a continuation of Ser. No. 778,631, filed Sept. 20, 1985, now abandoned, which was a continuation of Ser. No. 625,279, filed June 27, 1984, now abandoned.

This invention relates generally to a system and method for raising sunken vessels and more particularly to a method for raising sunken vessels from both divable and non-divable depths.

Raising sunken ships has been a problem that has generally been attempted to be solved by the placement of hoisting cables under the sunken vessel at regular intervals and hoisting the sunken vessel by way of the cables being drawn up by surface ships. Cables are not easily placed under a sunken vessel, especially at depths that are not easily divable. In difficult areas a typical method is for divers to drill holes transversely through the bottom portion a sunken vessel at regular intervals, draw cables through the holes and attach the cables to balloons which are inflated and sent to the surface.

A typical problem of raising sunken vessels is the occurence of the vessel breaking apart during the raising process. Another problem of raising sunken vessels is that generally a sunken vessel must be at a depth that allows divers to perform the tasks associated with securing the hoisting cables to the vessel. Still another problem occurs if the vessel is lying on a sea bottom that makes securing the vessel by divers difficult. Other problems occur if vessels are at a depth too great to dive, are in very cold waters, or are in underwater currents.

The present invention contemplates a method of raising a sunken ship that overcomes the limitations and disadvantages of the prior art by setting forth a system and a method that makes possible the raising of a sunken ship from shallow waters, divable depths, and non-divable depths by the application of cryogenic technology.

Accordingly, it is an object of my invention to set forth a system and a method of raising a sunken vessel by enclosing the vessel with ice so that the ice rises with the vessel to the surface where the vessel is floated by a barge.

It is another object of my invention to set forth a system and a method of raising a sunken vessel by applying a cryogenic fluid to a sunken vessel so as to form ice around it and so raise it by the action of the upwardly floating ice to the surface.

It is still another object of this invention to set forth a method of raising a sunken vessel by the application of liquefied nitrogen to the vessel so as to form ice in and around the vessel so as to float the vessel to the surface for salvage.

It is a further object of this invention to set forth a method of raising a sunken vessel from shallow water by the transfer of a cryogenic fluid a surface vessel to the sunken vessel so as to form gripping ice with the vessel so that the vessel floats to the surface with the ice.

It is another object of the invention to set forth a method of raising a sunken vessel from deep but divable water by positioning of a container of a cryogenic fluid proximate to the sunken vessel and transfering the cryogenic fluid to the area around the vessel so as to form a gripping ice mass that raises the vessel to the surface.

It is still another object of this invention to set forth a method of raising a sunken vessel from deep, undivable water by positioning a container of liquefied cryogenic gas proximate to the sunken vessel and transfering the liquefied gas to the area around the vessel so as to form an ice mass that grips the vessel and raises the vessel to the surface.

It is yet another object of this invention to provide a system for raising sunken vessels by the application of a liquefied cryogenic gas to the sunken vessel causing the vessel to be floated to the surface by ice formed around the vessel.

It is still another object of the present invention to raise a sunken vessel by laying refrigeration-type piping containing cryogenic fluid proximate to the vessel so as to build up a block of ice within and without the sunken vessel so as to cause it to be raised to the surface by action of the rising ice.

The present invention fulfills the above objects and overcomes the limitations and disadvantages of prior art by setting forth a method for raising a sunken vessel lying at the bottom of a body of water comprising the steps of positioning cryogenic apparatus in relationship with the sunken vessel, the cryogenic apparatus including a liquefied cryogenic fluid, and releasing the liquefied cryogenic fluid around the sunken vessel, the cryogenic apparatus being adapted to form an ice mass integral with the sunken vessel upon release of the liquefied cryogenic fluid, so that the sunken vessel is raised to the surface of the water by the force of the buoyancy of the ice. The cryogenic apparatus in one embodiment includes a main cryogenic container holding the liquefied cryogenic fluid, preferably liquefied nitrogen, above the surface of the water over the sunken vessel and cryogenic piping connected to the cryogenic container and positioned proximate to the sunken vessel. A further step of the method is transferring the liquefied cryogenic fluid in the main cryogenic container to the cryogenic piping so that ice is formed integral with the sunken vessel when the liquefied cryogenic fluid is passed into the cryogenic piping. A submerged cryogenic container is preferably provided that is connected to the main cryogenic container by a vertical transfer pipe and is further connected to the cryogenic piping; the submerged cryogenic container is positioned proximately above the sunken vessel. A piping header is preferably provided, which is connected to the submerged cryogenic container and to the cryogenic piping. The cryogenic piping preferably includes both inner and outer piping positioned inside and outside, respectively, the hull of the vessel, the outside piping extending bow to stern of the vessel so that ice is formed via the inner and outer piping within, under, and around the outer portions of the vessel. The submerged cryogenic container is held in position above the sunked vessel by cables attached to a surface ship or barge. In another embodiment, the submerged cryogenic container is directly attached to the sunken vessel, preferably by a magnetic appliance. A main vapor relief line for the submerged cryogenic container extends from the submerged container to a position above the surface of the water. A plurality of branch vapor relief lines extend from the cryogenic piping to main vapor relief line. In one embodiment, the cryogenic piping is filled with the liquefied cryogenic fluid when gravity pressure from the main tank feeds the submerged cryogenic tank and the main and branch vapor relief lines are filled with the liquefied cryogenic fluid. In another embodiment, the submerged cryogenic container is trickle-fed by the main cryogenic container so that liquefied cryogenic fluid in the submerged container is at slightly greater than atmosphere pressure and the main and branch vapor relief lines are devoid of liquefied cryogenic fluid. A pump and motor submerged in the liquefied cryogenic fluid feed the cryogenic piping in this last embodiment. In another embodiment, the cryogenic piping includes a plurality of valves that are adapted to release liquefied cryogenic fluid into the water around the sunken vessel upon remote signal. In another embodiment, the cryogenic piping is adapted to act as refrigeration coils, so that the ice around the sunken vessel is built up slowly. In yet another embodiment a plurality of small cryogenic containers each containing a cryogenic fluid are attached to the sunken vessel. Each small cryogenic vessel has outlet ports with valves that can be automatically activated with the other valves so that the liquefied cryogenic fluid is simultaneously released around the sunken vessel. A wire mesh or net is preferably positioned around the sunken vessel and the cryogenic apparatus prior to formation of the ice so that the net will aid in the positioning of the ice mass in integral relationship with the vessel during formation of the ice. Remotely operable disconnect fittings between the submerged cryogenic container and the cryogenic piping and the branch vapor relief lines and the main vapor relief line are provided so as to separate the cryogenic piping encased in the ice mass from the submerged cryogenic container, the vertical cryogenic transfer line, and the main vapor relief line.

My invention will be more clearly understood from the following description of a specific embodiment of the invention together with the accompanying drawings wherein similar reference characters denotes similar elements throughout the several views, and is which:

FIG. 1 is a schematic side view of a surface ship lowering a liquefied cryogenic gas container header and piping to a sunken vessel;

FIG. 2*a* is a schematic side view of the liquefied cryogenic gas header positioned over the sunken vessel and liquefied cryogenic fluid having been released in the holds of the vessel forming ice therebouts;

FIG. 2*b* is a schematic side view similar to and simultaneous in time sequence with FIG. 2*a* with the liquefied cryogenic fluid having been released to the outside of the vessel forming ice therebouts;

FIG. 10 is a sectional view of flexible walled cryogenic piping;

FIG. 11 is a sectional view of cryogenic piping;

FIG. 12 is a sectional view of a vacuum-walled cryogenic piping;

FIG. 13 is a sectional view of a special double-walled vacuum-insulated cryogenic piping:

FIG. 14 is a perspective view of flexible refrigeration-type cryogenic piping draped over a sunken vessel;

FIG. 15 is a perspective view of a section of flexible nylon refrigeration-type cryogenic piping;

Figure 1:
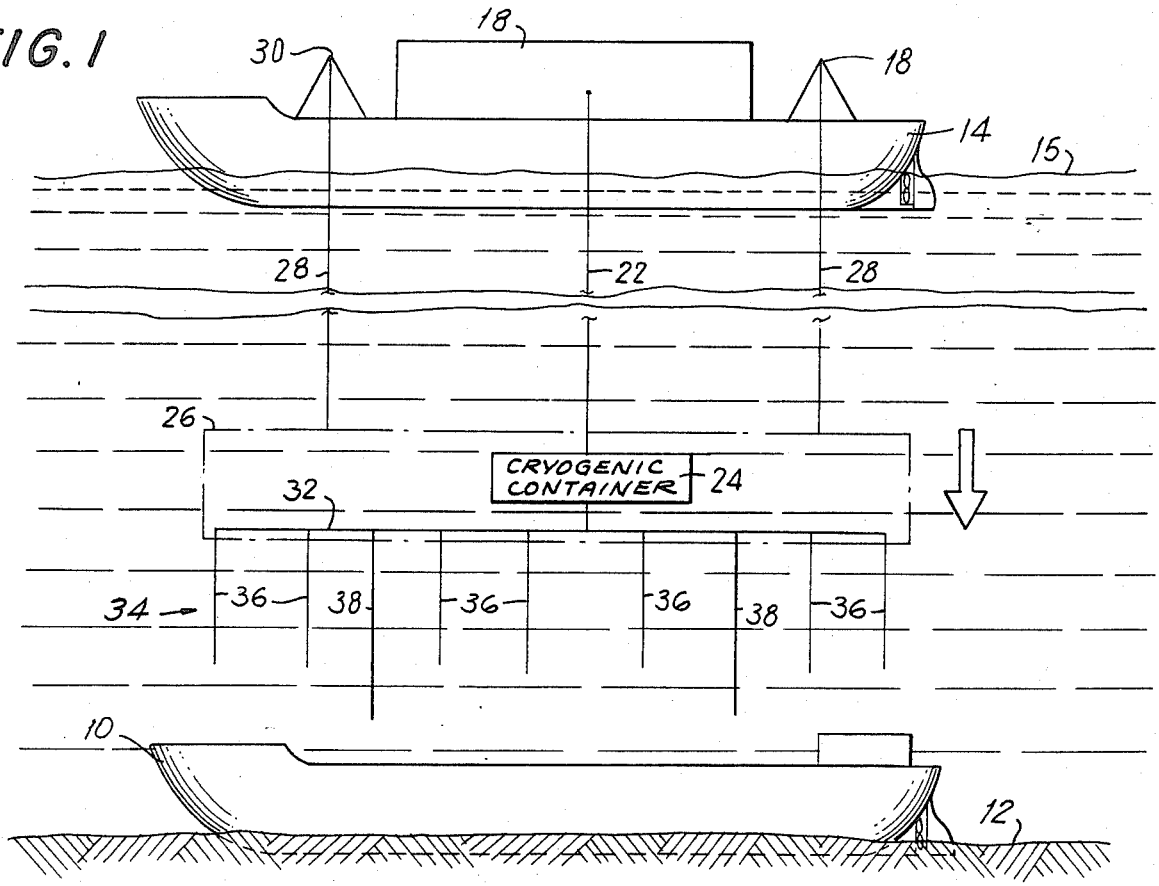

Reference is now made in detail to the dawings.

The system and method for raising a sunken vessel as described below can be applied in general to sunken vessels lying in shallow water, deep but divable water, and non-divable water. The temperature of the water can be of some consequence.

A situation that sets forth the system and method according to the invention is schematically shown in FIGS. 1–7. A fairly large sunken vessel is shown lying on a sea floor 12 slightly set into the soft sea bottom. The general alignment of vessel 10 is more or less idealized in that it is setting generally upright for purposes of exposition herein, but it is to be understood that the method and system set forth here are equally applicable to other situations, for example, to sunken vessels lying askew to sea floor 12, lying sideways on a hard or sandy sea floor, or lying deeper in mud than the soft bottom of FIGS. 1–5. A salvage ship 14 is riding on the surface 15 of relatively shallow water 16. The depth of water 16 in FIGS. 1–5 is such that, as will be described, the pressure on the under-water transfer tubing is such that the tubing can have limited flexibility and still be able to withstand distortion from external water pressure.

Salvage ship 14 supports a large cryogenic container 18 containing a liquefied cryogenic fluid 20 (seen in FIG. 5) that is connected by a vertical cryogenic transfer pipe 22 to a smaller submerged cryogenic container 24 that is mounted to a support frame, or structure, 26 that in turn is suspended directly above vessel 10 in a bow to stern alignment. Submerged container 24 is shown as cylindric with the opposed flat ends of the cylinder in horizontal alignment. The submerged container can have other configurations, one of which would be spherical, which is especially adaptable to deep water situations. Support structure 26 is a minimal lightweight structure that is optional; it can be provided with ballast tanks (not shown) and is shown as being support and maneuvereed from salvage ship 14 by way of fore and aft cables 28 connected to hoisting apparatus 30 mounted on salvage ship 14. Support structure 26 basically lends stability to submerged container 24 and to its connected header 32 and cryogenic piping 34 emanating from the header. Support structure 26 is shown in phantom lines in FIGS. 1–3 and its presence is to be assumed hereinafter when conditions call for it. Appropriate valving and instrumentation (not shown) regulate the flow of liquefied cryogenic fluid 20 from large container 18 to submerged container 24. Gravity is preferably the transfer force. Both large cryogenic conainer 18 and submerged cryogenic container 24 are provided with insulation (not shown) according to methods well-known in of cryogenic art.

At this point it is noted that certain preparatory steps have been to her with regard to the salvage operation. For example, the dimensions of vessel 10 and its dead weight are determined, and the amount of ice required to lift vessel 10 to the surface is calculated. It cannot be said that in all cases submerged container 24 must be supplied with liquefied cryogenic liquid by large container 18; in certain conditions submerged container 24 may contain enough liquefied gas to raise vessel 10 without vertical transfer pipe 22 to large container 18. Likewise, in very shallow water submerged container 24 may be dispensed with a header 32 and piping 34 that can be supplied directly by large container 18. Piping 34 includes paired outer piping 36 and a pair of inner pipes 38 that both are connected to header 32.

The liquefied cryogenic fluid used for this invention is preferably liquefied nitrogen, which has a boiling point of about −320.4° F. (77.4° K.) at one atmosphere. The temperature of the liquefied nitrogen used is, of course, considerably below the boiling point. The liquefaction, storage, and transfer technologies for liquefied cryogenic fluids are well-known in the art. Nitrogen is one of the more inert of the cryogenic fluids, although it is not perfectly safe and its vapor does react with oxygen. Another safety hazard of liquefied cryogenic fluids occurs in changes of properties of the system subject to the low-temperature environment. It is noted here that liquefied nitrogen does not have to be stored, transferred, and handled in a closed system that is maintained at a pressure greater than atmospheric pressure, as does, for example, liquefied helium.

Submerged container 24 is connected to header 32 which is in turn connected to a plurality of paired cryogenic transfer pipes 36 extending transversely outwardly from the header then downwardly around vessel 10. Header 32 extends from bow to stern of vessel 10. Paired outer pipes 36 connected to header 32 are positioned proximate to the outer shell of vessel 10; the number sets 36 shown in the embodiments herein is seven, three forwardly of and three aftwardly of, and one at centrally located submerged container 24, as a matter of exposition and convenience. The number of sets are dependent upon the size and dimension of the particular vessel being raised. Paired pipe sets 36 are capable of generally covering the entire outer shell of vessel 10. Whenever possible internally positioned cryogenic piping 38 capable of extending directly vertically downwards from header 32 through the hatches into the holds of vessel 10 is provided.

FIG. 1 schematically shows support structure 26 being lowered from salvage ship 14 towards submerged vessel 10. Piping pairs are lowered through the hatches of vessel 10 into the vessel's holds. This is accomplished by prefabrication and maneuvering of pipes 38 through the hatches by manipulation of support structure 26. In the particular relatively shallow water operation being described herein and as illustrated in FIGS. 1–5, divers maneuver flexible paired transfer lines 36 close to the outer hull of vessel 10 and particularly close to the bottom portion of the vessel. Preferably, a network of branch lines extending from cryogenic piping 36 each having an outlet valve, as will be discussed later, are arranged around the length of the vessel. When lines 36 and 38 are positioned in place and the divers have returned to the surface, a signal is sent from salvage ship 14 to open the valves associated with submerged cryogenic container 24 leading to header 32, particularly main header valve 40 between submerged container 24 and header 32, seen in FIGS. 4 and 5. Outlet valves at the ends of cryogenic piping 36 and 38 are arranged to open simultaneously preferably by timed pressure release mechanisms so that liquefied nitrogen 20 (which is indicated in FIG. 5) flows from submerged container 24 by force of gravity to piping 36 and 38 and into the area of sea water 16 proximate to vessel 10 so that an ice mass 44 is formed within and around vessel 10. When ice mass 44 forms it will move upwardly in the water along with vessel 10. It is important to note that ice 44 is to be formed in all areas of the vessel more or less simultaneously so that one end of the ship does not become enclosed with ice before the other end and begins to rise and so shed the ice formed.

Figure 2A:
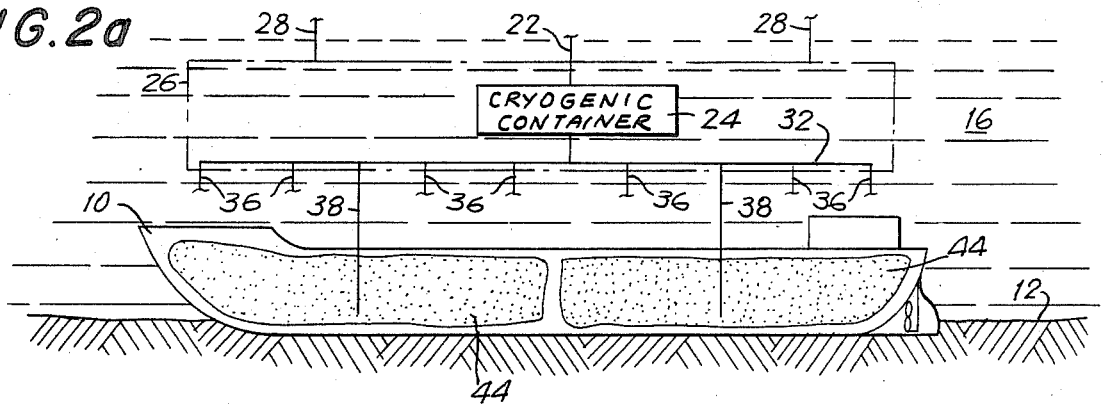
Figure 2B:
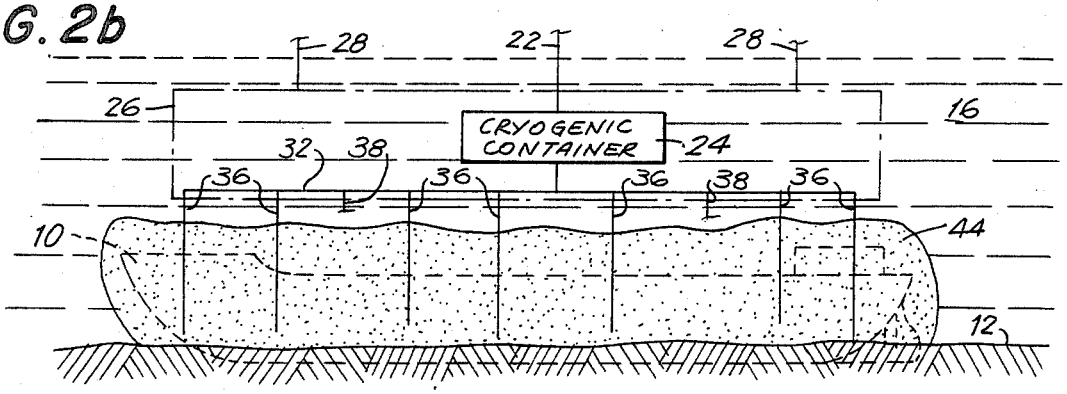
Figure 4:
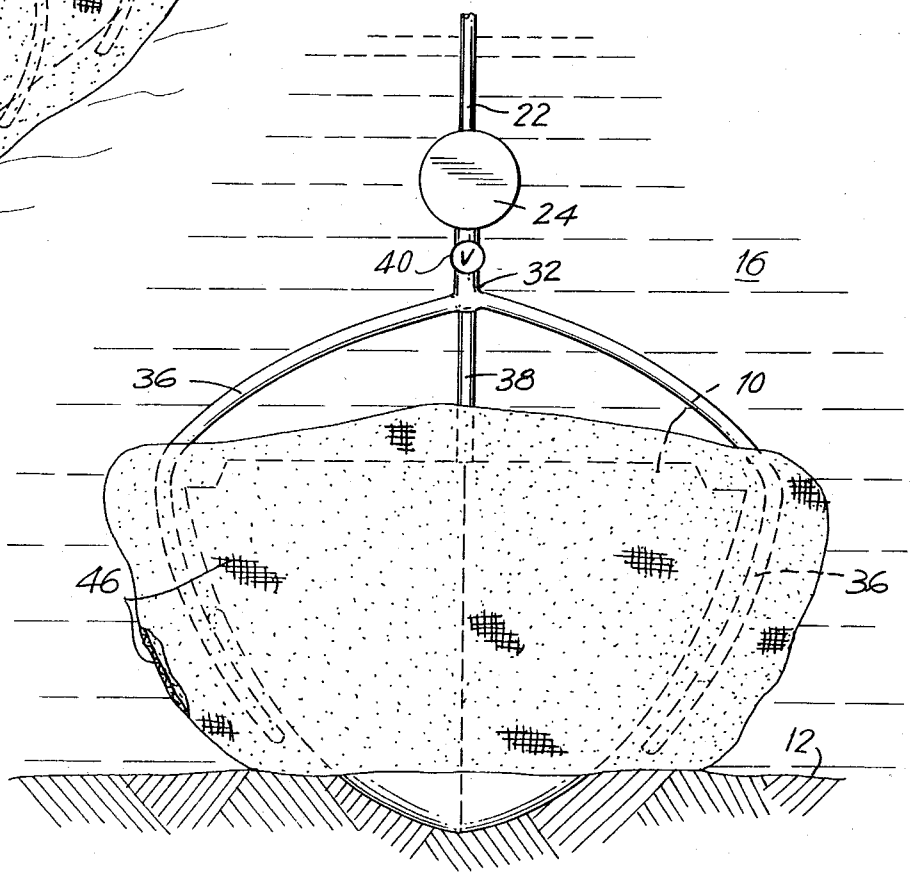
FIG. 4 is an end elevational view of the sunken vessel showing the cryogenic piping and steel mesh netting.
Figure 3:
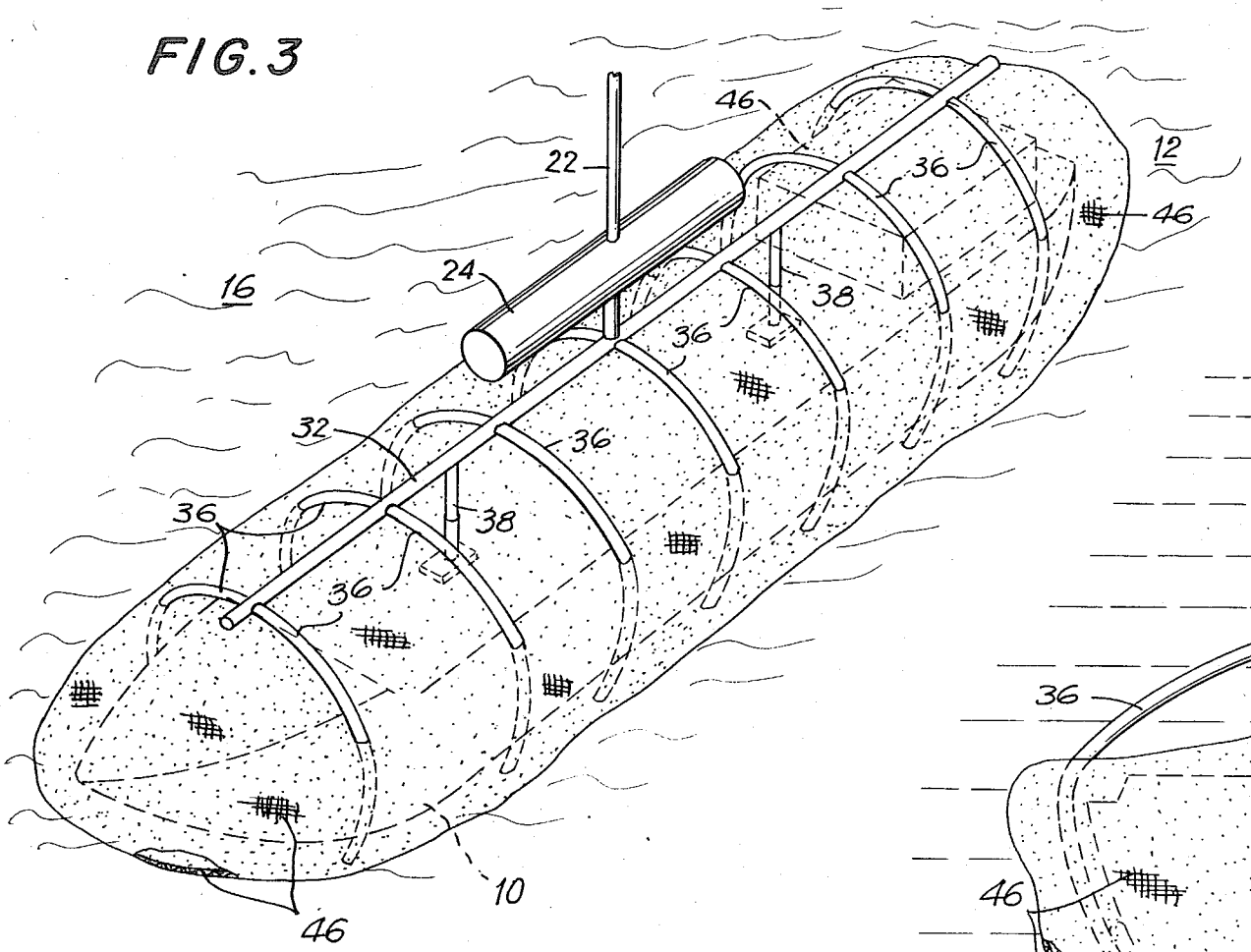
FIG. 3 is a perspective view of the sunken vessel with the cryogenic piping in position and a steel mesh netting enclosing the vessel and piping prior to icing.
Figure 5:
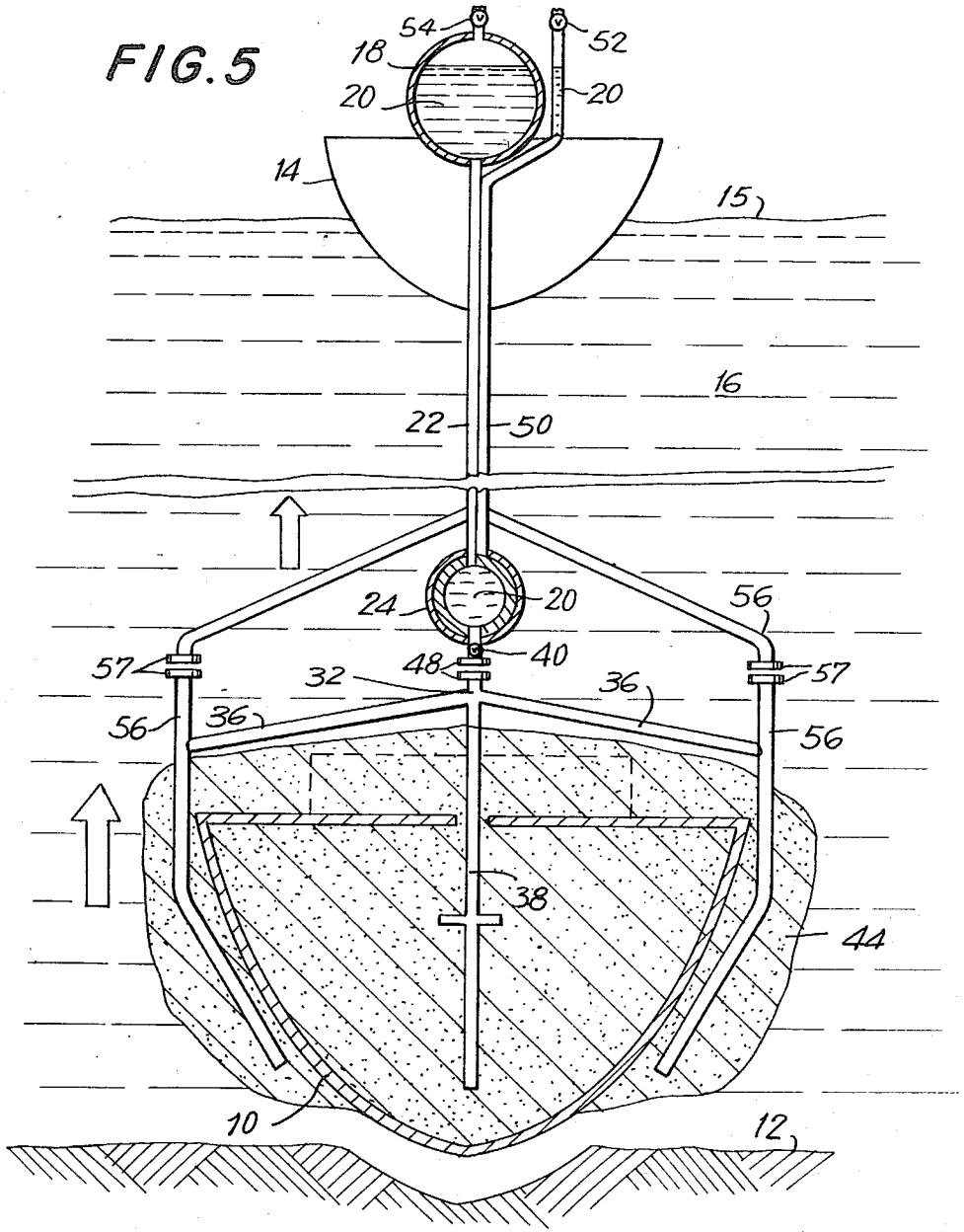
FIG. 5 is a sectional end view of the iced sunken vessel in the process of being raised to the surface with vapor release lines indicated.

In order to concentrate the formation of the ice around vessel 14, a steel mesh net 46, shown in FIGS. 3 and 4, is positioned by divers so as to enclose vessel 10 and piping 36 and 38 to a point below submerged container 24. Ice 44 will be trapped within net 46 and so concentrated around the vessel. Net 46 does not have the strength needed to help raise the vessel. It is worth mentioning here that after ice 44 is formed at about 32° F., the ice does not remain at just below 32° F., but in fact the temperature of ice 44 will continually drop as it looses its heat to the liquefied cryogenic fluid. Thus, new ice 44 can be formed by other ice that is far below the 32° F. necessary to freeze the surrounding water. In this manner, with ice 44 being drained of its heat that is used to warm liquefied nitrogen 20, the entire vessel 10 is encased in ice 44. The metal plate of vessel 10 also will drop to temperatures far below 32° F. and will also be active in forming ice 44 in its vicinity. As shown in FIG. 2*a*, ice 44 will be formed inside of vessel by vertical pipes 38, while ice 44, as shown in FIG. 2*b*, is formed by the action of liquefied nitrogen at paired pipes 36. As noted above, the ice-forming action shown throughout FIGS. 2*a* and 2*b* is more or less simultaneous. At a certain point, when sufficient ice has been formed within and around, and particularly towards the underside areas of vessel 10, the vessel will break free of sea floor 12, as shown in FIG. 4, and rise to the surface of the sea. Support structure 26, submerged container 24, and all the piping will likewise be forced upwards. At this time, submerged container 24 is separated from the rest of the piping as shown in FIG. 5. Piping 36 and 38 are at this time encased in ice 44 and so must go to the surface with vessel 44. The separation of submerged container 24 from header 32 is accomplished at a disconnect fitting 48 immediately below main header valve 40. Disconnect fitting 48 can be activated to disconnect by remote signal in a manner known in the art and is adapted to self-seal upon disconnection.

Liquefied cryogenic fluid is constantly vaporizing in various amounts depending on variable conditions. The vapor must be vented. FIG. 5 schematically indicates a main vapor relief line 50 that extends upwardly from submerged container 24 to a relief valve 52 that is preferably at about the same level as relief valve 54 for large cryogenic container 18 on salvage ship 14. Secondary vapor relief lines 56 extend from paired piping 36 to join vapor relief line 50. Vapor relief lines (not shown) likewise extend from the two vertical lines 36 to vapor relief line 50. Vapor relief line 50 is by the nature of the operation filled with cryogenic fluid, so that the cryogenic vapor must pass upwards through the liquid. It is not impossible that the vapor be directed into transfer pipe 22, but this would create a two-way movement of liquid and vapor. It is expected that the primary vapors will form after main valve 40 is opened and liquefied nitrogen passes to piping 36 and 38 for the reason that piping 36 and 38 is preferably flexible and is not as well-insulated as vertical transfer pipe 22 and submerged container 24. Each secondary vapor relief line 56 is provided with a disconnect fitting 57 that can be activated to disconnect by remote signal in a manner known in the art and is adapted to self-seal upon disconnection.

As vessel 10 becomes encased in ice 44, it will become more buoyant until such time as the vessel and the encased ice will begin to rise to the surface. As can be seen in FIG. 5, piping 36 and 38 will be encased in the ice so that, if container 24, header 32, support structure 26, transfer pipe 22, and main vapor relief line 50 are not to be lifted upwards as added bulk, or even prevent the rising of the vessel and ice, disconnect fittings 48 and 57 are activated so as to free the items named from the vessel and ice mass.

It is worth mentioning at this point that before the above steps are taken, preparation of the salvage system with its cryogenic container 22, transfer line 22, and piping 36 and 38 is necessary. This preparation includes a review of pertinent data on submerged vessel 10, including its size, disposition on the sea floor, the depth at which it is lying, its hatch locations, and so on, by whatever method best suits the particular operation including underwater photography. The cryogenic salvage system, including support structure 26, transfer pipe 22, submerged cryogenic container 24, header 32, and piping 36 and 38 in the embodiment of FIGS. 1–5 are manufactured or selected according to the particular salvage task. Dismountable couplings or unions are used to assemble pipe segments into the configurations required on shore or on ship in a manner known in the art.

Flexible piping 36 and 38 is preferably made of a thin-walled material such as copper or stainless steel. FIG. 10 shows a cross-section of a thin-walled piping 58 including an optional outer layer of anti-corrosive material 60 such as bitumen. A flexible material that has combined anti-corrosive and insulating qualities can also be used. The thin wall of piping 58 passes the relative heat of the sea water to the cryogenic fluid thus creating vapor, but the loss of heat in itself is to be considered against the gain in the flexibility of the piping. FIG. 11 shows a double-walled piping with insulation 62 between a thin inner wall 64 and an outer wall 66 that can be used as flexible piping. FIG. 12 illustrates one type of vacuum insulation pipe that could be adapted to transfer pipe 22, which will extend into the sea from the salvage ship either, in shallow or deep waters. A center pipe 68 is surrounded by an insulation 70, which in turn is surrounded by an outer pipe 72. A vacuum space 74 is formed between center pipe 68 and outer pipe 72; this space is drawn of air so that a vacuum insulation is made in space 72, a process which is well-known in the art and is done during the assembly of transfer pipe 22 on the salvage ship. In the case of very deep waters where the outer pipe may be pressed into the vacuum spaces by the pressure of the sea water, a vacuum-insulation pipe is shown in FIG. 13 having a center pipe 76 spaced from a middle pipe 78 in turn spaced from a thickwalled outer pipe 80. Insulation 82 between center and middle pipes 76 and 78 form vacuum-insulation space 84 between center and middle pipes 76 and 78. An outer insulation 86 having resistance qualities is positioned between middle and outer pipes 78 and 80.

Figure 6:
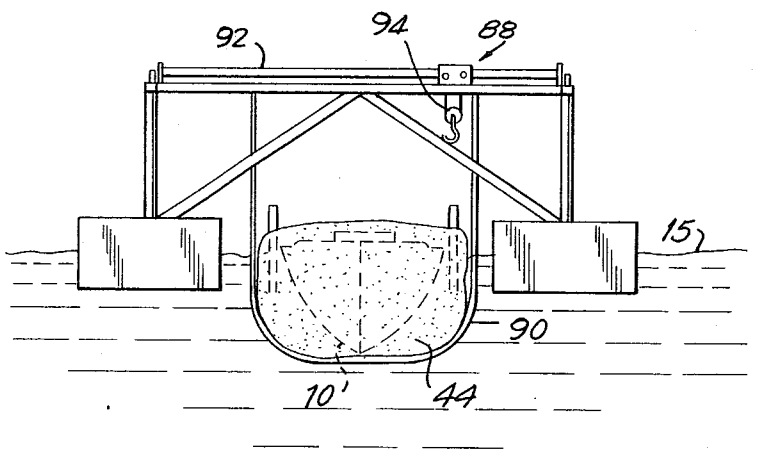
FIG. 6 is an end view of the raised iced vessel being held by the pontooned salvage barge.
Figure 7:
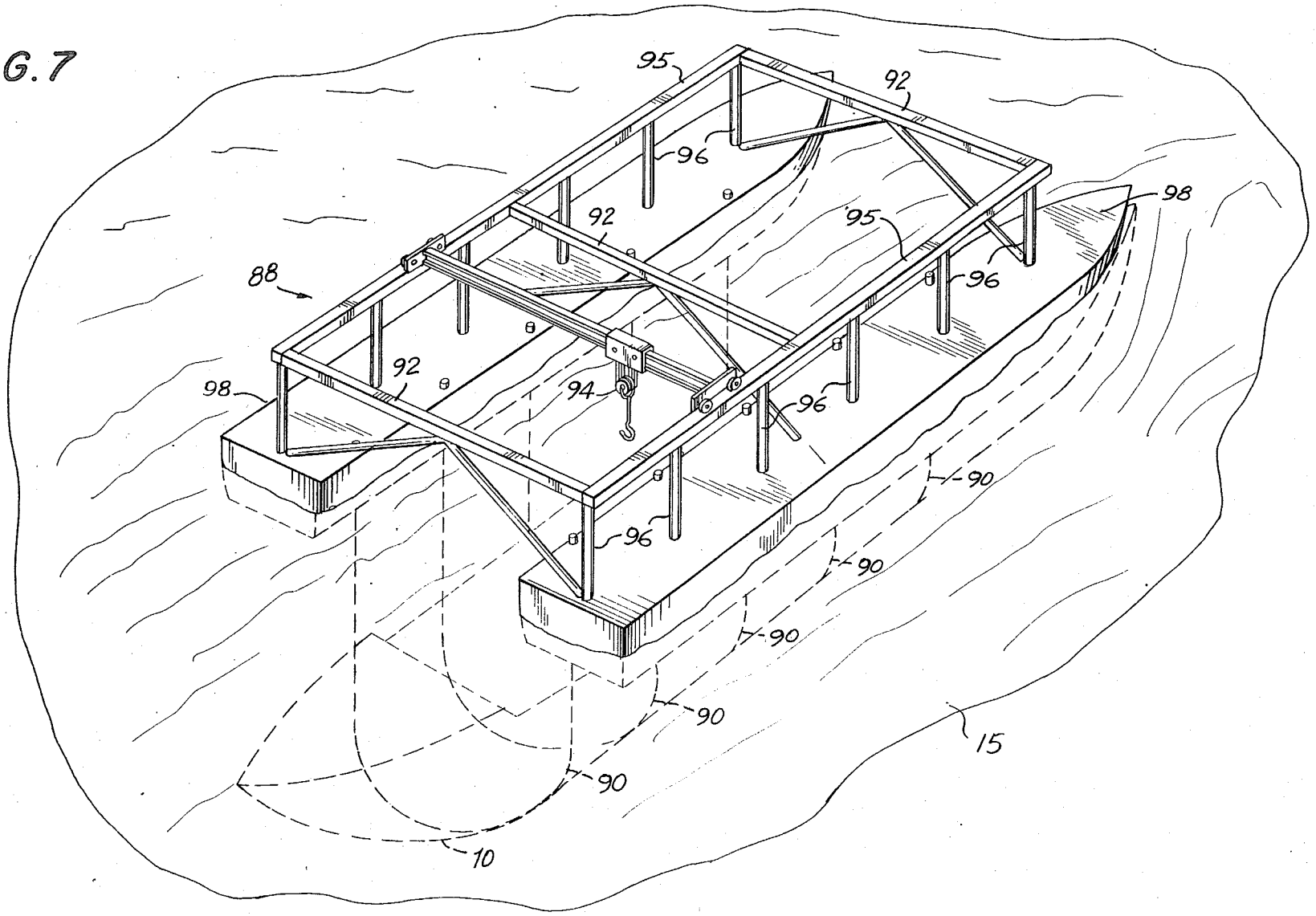
FIG. 7 is a perspective view of the salvage barge.

After vessel 10 has been raised to be surface by encasing ice 44 freed of submerged container 24 and transfer pipe 22, the entire mass, including ice 44 and vessel 10, is captured by a catamaran type barge 88 by way of by a series of underlying cables 90, shown in FIGS. 6 and 7, which in turn are secured to cross beams 92, which are set upon lateral beams 95 in turn secured to vertical supports 96, which are mounted upon a pair of pontoons 98. Transfer of barge 88 with vessel 10 to a port can proceed immediately. In cold waters, ice 44 may not melt or may melt slowly, depending on the exact conditions. In warm waters, ice 44 will melt rapidly. Cables 90 can be adjusted to accommodate changes in the size of the mass by overhang winch 94. FIG. 6 shows vessel 10 encased in ice mass 44 and FIG. 7 shows the vessel free of ice.

Certain problems in the process occur all of which are not handled in detail herein or they are not directly a part of the inventive process. One such problem is the upward movement of vessel 10 under salvage ship 14 after the ice is formed around the vessel. In fact, a barge holding the main cryogenic container 18 and hoisting apparatus 30 may accompany salvage ship 14 so that upon movement of vessel 10 and the freeing of container 10 and transfer pipe 22, the barge can be towed out of range by the salvage ship. In this manner, salvage ship 14 will be clear of vessel 10 at all times. This feature is apparent and not illustrated, but is considered to be a part of this invention.

Figure 8:
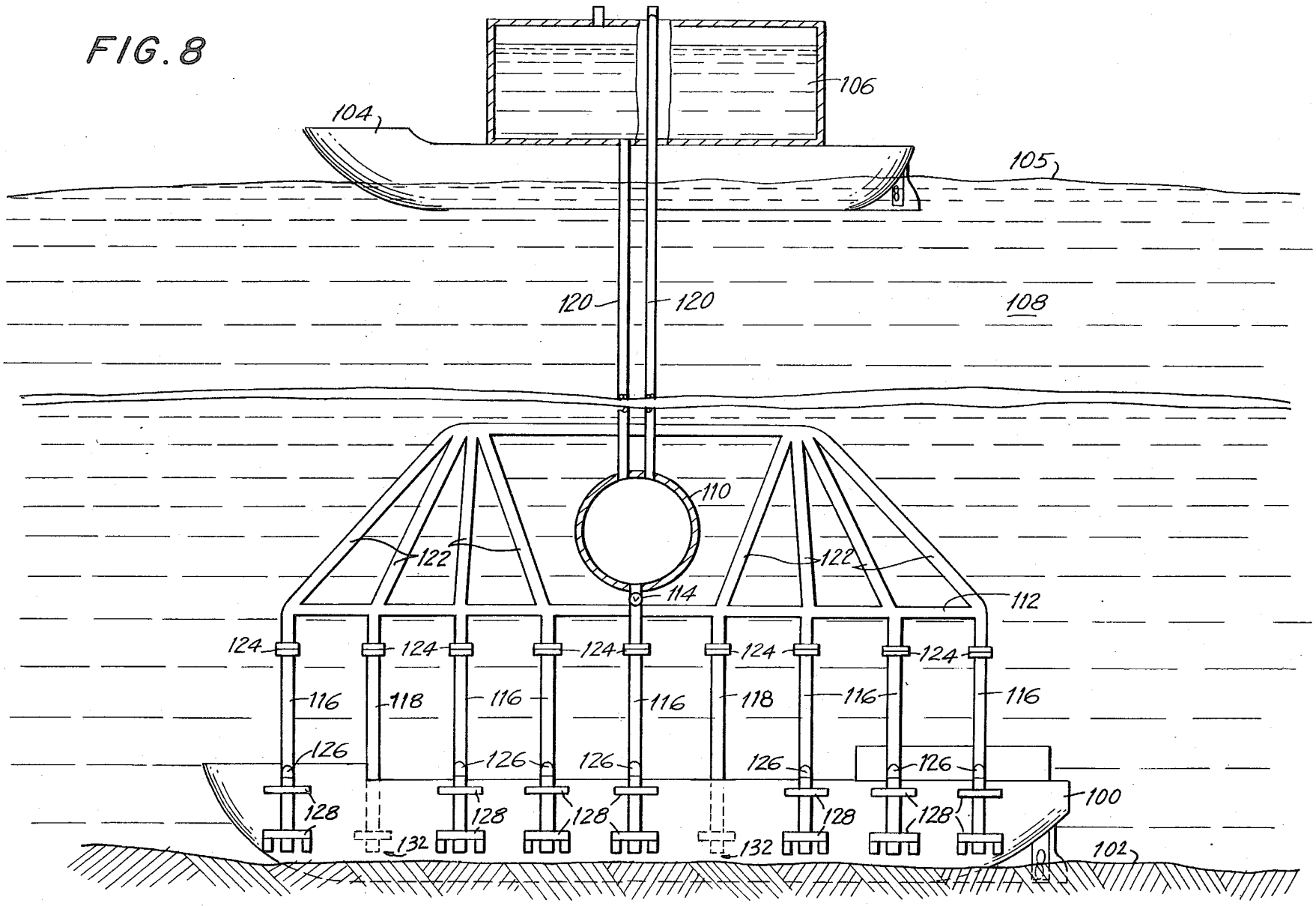
FIG. 8 is a side view of a sunken vessel at a non-divable depth with remotely controlled cryogenic piping in position around the vessel.
Figure 9:
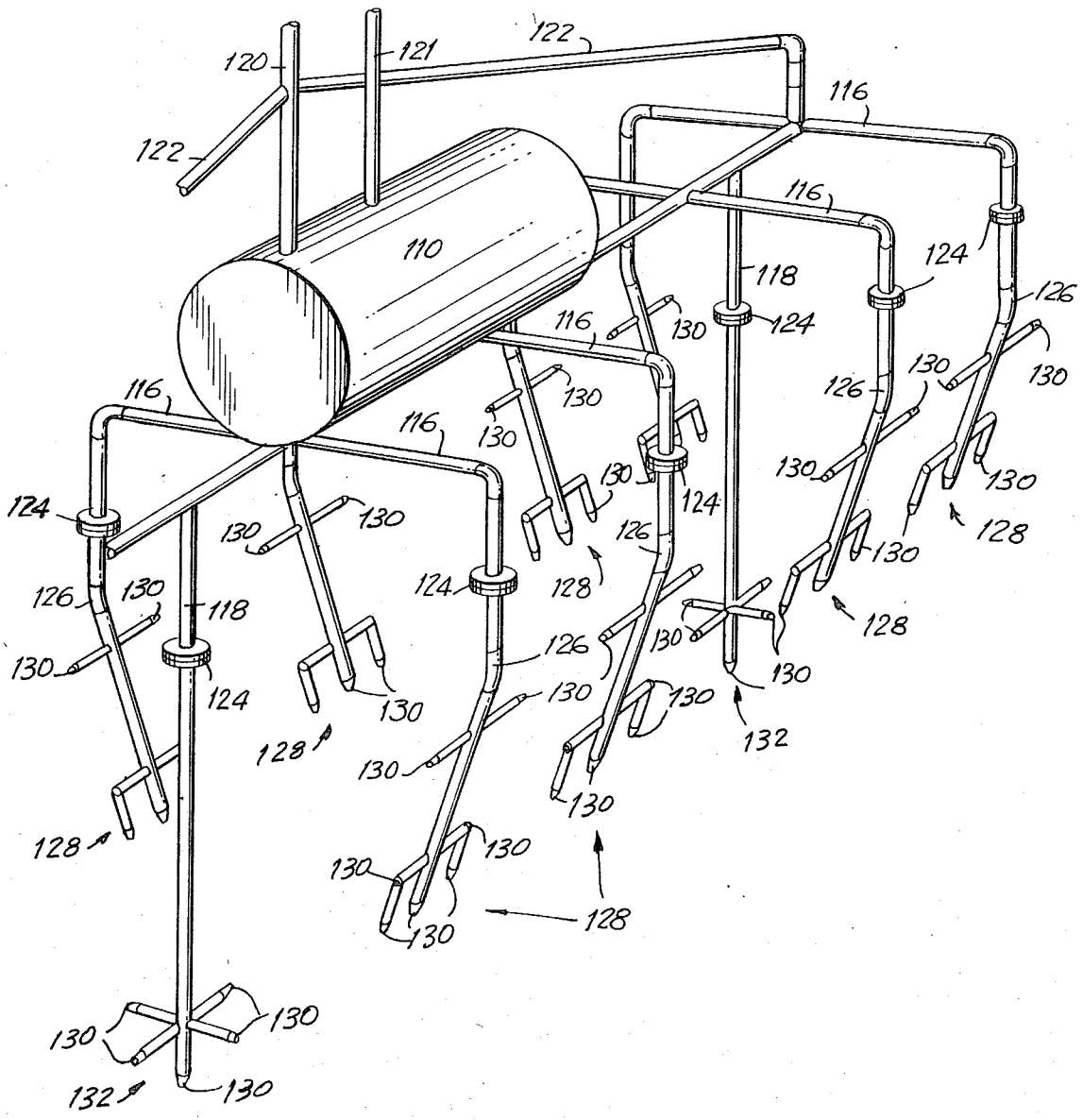
FIG. 9 is an isolated perspective view of the remotely controlled cryogenic piping shown in FIG. 8.

In those situations where the sunken vessel is lying too deep for divers to work with safety or efficiency or at all, the system and method described relating to FIGS. 1–7 above must be adapted to operate by remote control. In addition, greater pressures will be encountered. FIGS. 8 and 9 schematically illustrate such a system. As seen in FIG. 8, a sunken vessel 100 is lying on a sea floor 102. A salvage ship 104 lying on sea surface 105 carrying a large cryogenic container 106 is at the surface of sea water 108. A submerged cryogenic container 110 lies directly above vessel 100. Submerged cryogenic container 110 is shown for purposes of exposition as spherical, which is an alternative configuration to the cylindrical configurations of the cryogenic container shown prior. A vertical cryogenic transfer pipe 111 from main cryogenic container 106 feeds submerged cryogenic container 110. A central header 112 disposed midships aft to stern of vessel 100 is connected to the bottom of submerged container 110 at main valve 114, which is in the off position in FIG. 8. Nine paired pipings 116 extend from header 112 and extend downwardly from header 112 and two vertical pipes 118 extend into the hold of vessel 100. A vapor relief line 120 extending upwardly from submerged container 110 is joined by secondary vapor relief lines 122 from piping 116 and 118. In addition, pipings 116 and 118. are provided with remotely operated release couplings 124 that are activated after ice has been formed around the vessel and encloses piping 116 and 118.

The same system described above is seen in partial perspective isolation in FIG. 9. FIG. 9, in addition, shows the operation of inwardly rotatable joints 126 that are activated to rotate towards the hull of vessel 100 after the system has been lowered into position around vessel 100. Rotatable joints can be spring-based inwardly upon remote electronic signal from the salvage ship so that they come to inward rest against or proximate to sunken vessel 100.

At this point, it can be said that both the embodiment shown in FIGS. 1–5 and the embodiment of FIGS. 8 and 9 under discussion are preferably provided with a piping network 127 shown in one general form in FIG. 9. Piping network 127 includes a triple-formed piping unit 128 at the end of each paired piping 116 extending from a transverse head and a transverse pipe above the transverse head. Time-pressure release valves 130 are positioned at each piping extremity of each network 127. Network 127 can be fabricated into many other configurations within the spirit of the invention. Likewise, vertical piping 118 is preferably provided with a horizontal cruceform piping configuraton around the bottom portion of each pipe 118 with time-pressure release valves 130 also provided at the end of each piping extremity. Upon arrival of the liquefied nitrogen, valves 130 will be activated to release after a time interval in order to allow all the valves to open at about the same time so as to avoid icing imbalance. The time release interval is calculated according to the length of the pipe that the liquid nitrogen is being pressured before it arrives at each terminal.

It is to be noted that at great depths pipig 116 and 118 will have to bear outside water pressure directed inwardly against a hollow pipe. Once the liquid nitrogen enters piping 116 and 118, the inner and outer pressure will equalize. But until that time, because of the one-sided pressure, a double-walled pipe, such as that shown in FIG. 11, discussed previously, may be required.

Up to this time, the system for icing the water around the sunken vessel has included an outlet valve that passes liquefied cryogenic fluid to the water to form the lifting ice. It is possible, however, to employ cryogenic piping laid about the sunken vessel as refrigeration coils that contain the liquefied cryogenic fluid so that an ice mass slowly forms about each coil until the vessel becomes buoyant. Such an arrangement is shown in FIG. 14 where a sunken vessel 140 is shown in perspective lying on a sea bottom 142 and surmounted by a submerged cryogenic tank 144 that is connected via vertical transfer line 146 to a surface salvage ship (not shown). A header 148 shown extending aft to stem over vessel 140 is connected to a submerged tank 144. Nine equally spaced paired coils 15 extend from header 148 and lie over the decks and down the sides of the sunken vessel, while a pair of coils 152 extend into the holds of vessel 140. Suitable valving and controls send liquefied cryogenic fluid, preferably liquefied nitrogen, from submerged tank 144 to coils 150 and 152. Vapor formed in coils 150 and 152 is returned to the surface by way of vapor relief lines (not shown) similar to these shown in FIGS. 5, 8, and 9. It is to be noted that considerable vapor will be formed in coils 150 and 152 since heat is being absorbed within the coils. For this reason, the vapor relief lines will be fairly large. As vapor is lost, additional liquefied nitroged in supplied to submerged tank 144 from the main cryogenic supply tank at the surface.

Coils 150 and 152 are preferably nylon coils 154 with outside reinforced steel mesh 156 as shown in FIG. 15 when vessel 140 lies in shallow water. That is, distortion of coils 150 and 152 by the pressure of the water before movement of the liquedized hydrogen into the coils can be resisted by mesh 156, so that the flexible nylon coils are adaptable to being draped over the top of sunken vessel 140. In deep water, the flexible single wall piping shown in FIG. 10 may be used. Because piping 150 and 152, as noted above, are refrigeration coils, insulation is not a requirement. In order to slow the buildup of the ice, however, same insulation may be desirable, so that double-walled piping similar to that shown in FIG. 11 may be used; such double-walled piping is also adaptable for use in deep water since it provides greater resistance to water pressure distortion.

Figure 16:
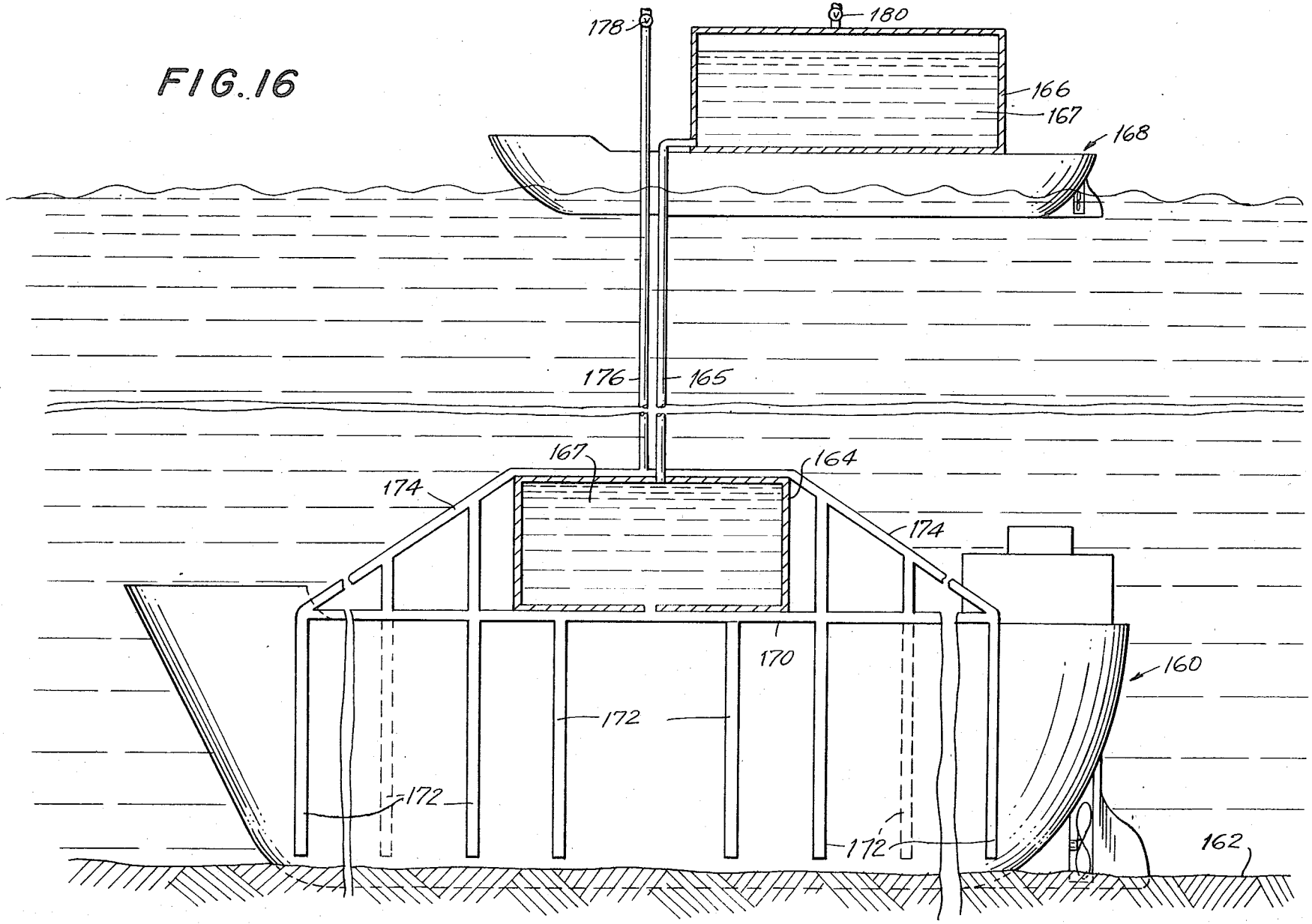
FIG. 16 is a sectional side view showing a submerged cryogenic container magnetically attached to the sunken vessel.

Another method of mounting a submerged cryogenic container to a sunken vessel is shown in FIG. 16. Sunken vessel 160 lying on sea floor 162 has held to its deck area, by magnetized cylindrical submerged cryogenic container 164 holding liquefied cryogenic fluid 167 which is fed via transfer pipe 165 by a main cryogenic container 166 supported by salvage ship 168. A pair of headers 170 (one of which is seen in FIG. 16) extending horizontally bow to stern of vessel 160 are connected to submerged container 164 at a pair of main valves 169 (one of which is seen). A grouping of cryogenic pipes 172 extend around the outside of the hull of vessel 160 and within its hold. A series of vapor relief lines 174 connected to pipes 172 join vertical vapor relief lines 176 which extend between container 164 and vapor relief valve 178 which is disposed at about the same level as vapor relief valve 180 for main cryogenic container 166. In this embodiment, a structure such as support structure 26 discussed in relation to FIGS. 1–3 is dispensed with. It is noted, however, that, on the other hand, submerged container 164 could be supported by a support structure magnetized in a manner known in the art that in turn is magnetically attached to the deck of vessel 160.

Figure 17:
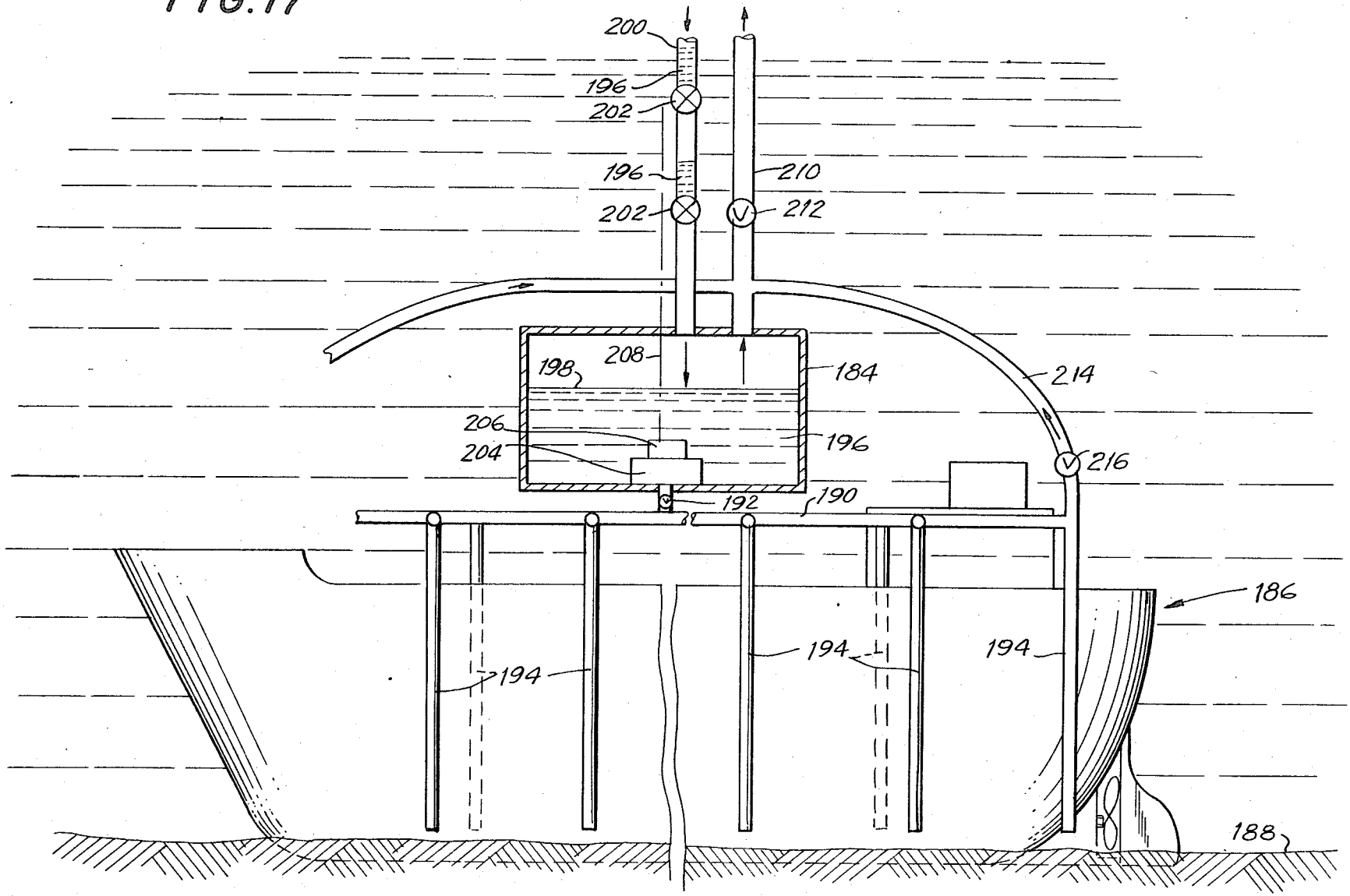
FIG. 17 is a sectional side view showing liquefied cryogenic liquid under pressure slightly greater that atmospheric pressure and further showing a pump and motor submerged in the liquefied cryogenic liquid.

Another embodiment of the cryogenic vessel raising system is shown in FIG. 17 where a submerged cylindrical cryogenic container 184 positioned above a sunken vessel 186 lying on sea floor 188 is connected to a horizontal bow to stern header 190 by way of a main valve 192. A grouping of cryogenic piping 194 extends outside of the hull of the vessel and within its hold. A liquefied cryogenic fluid 196 preferably liquefied nitrogen, is contained in container 184, which is connected to a main surface cryogenic container (not shown).

Fluid 196 has a liquid level 198 in container 184 with fluid 196 being under a pressure slightly greater than atmospheric being positioned below sea level. Liquefied nitrogen 196 is trickle-fed from the main surface tank through vertical transfer pipe 200 along which are positioned a number of pressure release valves 202 that pass fluid 196 in non-pressured steps to container 184. A pump 204 with accompanying electric motor 206 are submerged in liquefied nitrogen 196 at the bottom of container 184; motor 206 is driven by electric power line 208 that extends from the surface salvage ship (not shown). A remote signal from the surface ship opens valve 192 and activates motor 206 and pump 204 to drive liquefied nitrogen 196 to piping 194 where ice is formed around vessel 186 either by ejection of the nitrogen into the sea or by the refrigeration method described above with reference to FIG. 14. In this embodiment a vertical vapor relief line 210 connected to container 184 has its vapor relief valve 212 not far above the container. It is particularly noted that vertical vapor relief line 210 is free of liquefied nitrogen so that nitrogen vapor can rise without interference to the surface. Branch vapor relief lines 214 from piping 194 is connected to vertical vapor relief line 210 below relief valve 212. Branch line vapor relief valves 216 (one of which is shown in FIG. 17) are positioned between piping 194 and container 184 to prevent pumping of the cryogenic fluid back into container by way of branch lines 214. It is to be noted that because of pressure problems especially in deep water, the embodiment of FIG. 17 is more adaptable to the refrigeration line system described relative to FIG. 14.

Figure 18:
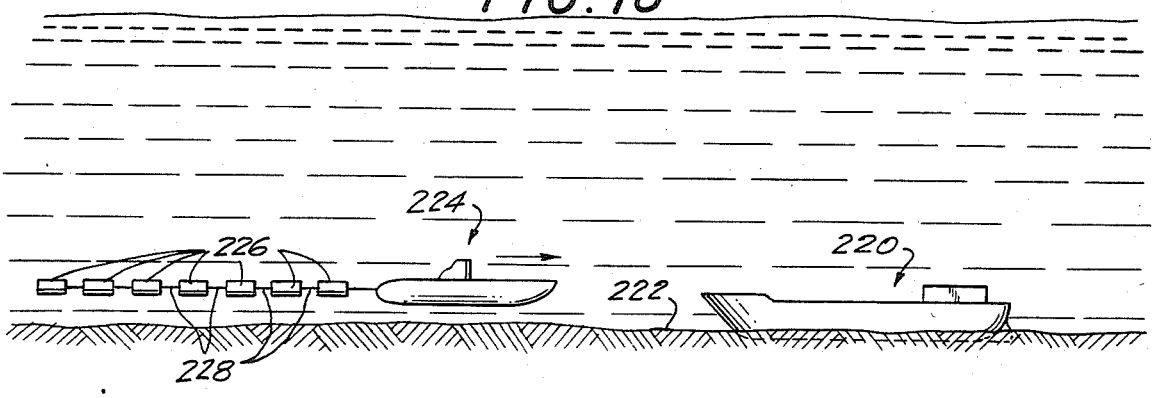
FIG. 18 is a view of submarine work-ship pulling a group of magnetically attachable small cryogenic tanks approaching a sunken vessel.
Figure 19:
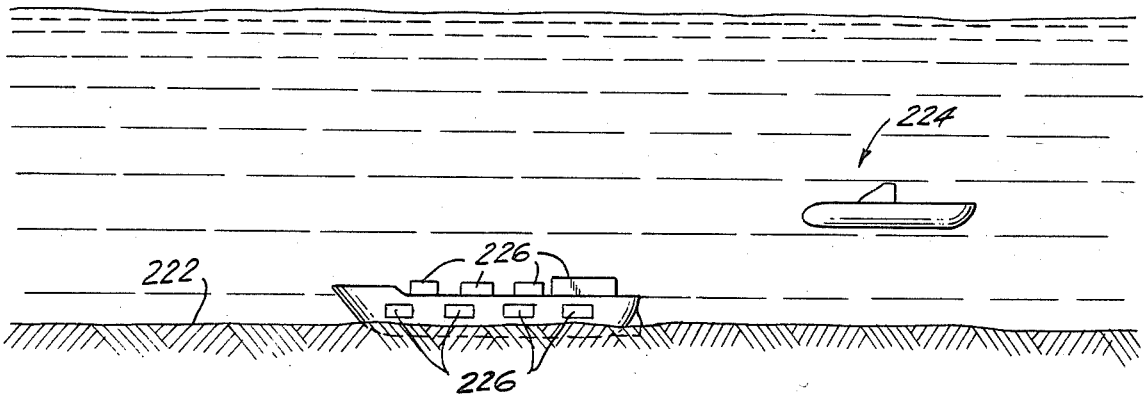
FIG. 19 shows the small cryogenic tanks magnetically attached to the sunken vessel.
Figure 20:
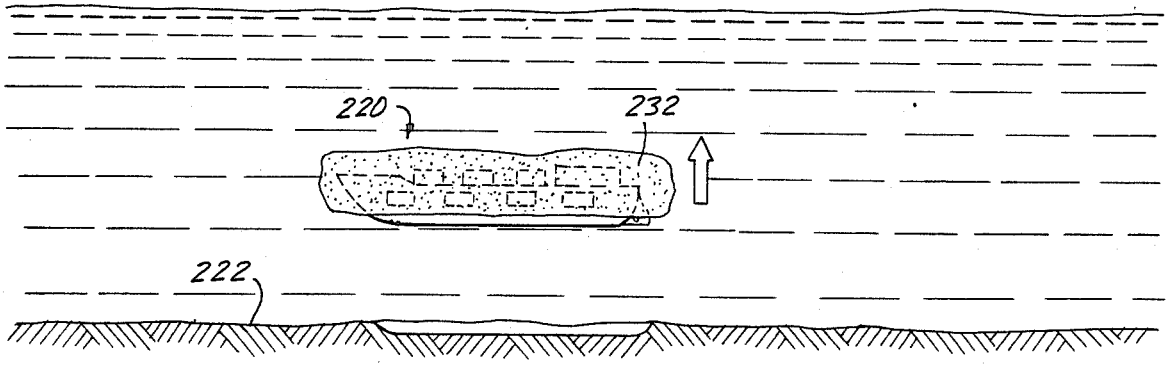
FIG. 20 shows the iced sunken vessel being raised with the spent magnetically attached cryogenic tanks.
Figure 21:
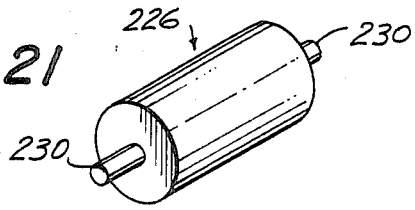
FIG. 21 shows an isolated small cryogenic tank.

Another method of forming ice around a sunken vessel is described in FIGS. 18–21. FIG. 18 shows a sunken vessel 220 lying on a sea floor being approached by a submarine 224 that is trailing a group of cylindric cryogenic containers 226 connected in series by remotely releasable cables 228. Containers 226 are magnetically treated and so when each is released against the hull of vessel 220 that container remains attached to the hull. In this manner both sides of the hull of vessel 220 are mounted with cryogenic containers 226. In addition, the submarine can drop containers 226 on top of the vessel or into the hold of the vessel through the hatchways. As shown in FIG. 21, each container 226 is equipped with an opposed pair of valves 236 positioned at the opposed flat surfaces of the container. Valves 230 are remotely controlled to open upon receipt of a signal from the salvage ship (not shown). When ice 232 has encased the vessel, it will begin to rise to the surface as shown in FIG. 20.

After the sunken vessel has been raised to the surface by the ice, additional formation of ice to the ice already formed in and around the vessel may be necessary. For example, the keel area of the raised vessel may need added ice. Also, especially in warm waters, the ice around the raised vessel may begin to melt during the capturing procedure that secures the vessel to the salvage barge. The cryogenic fluid used to form the ice at the sea bottom can be further employed to form ice with the vessel at the surface. In addition, formation of ice at one area or another of the raised mass of vessel and ice may be needed to right the vessel for salvage barge operation.

Figure 22:
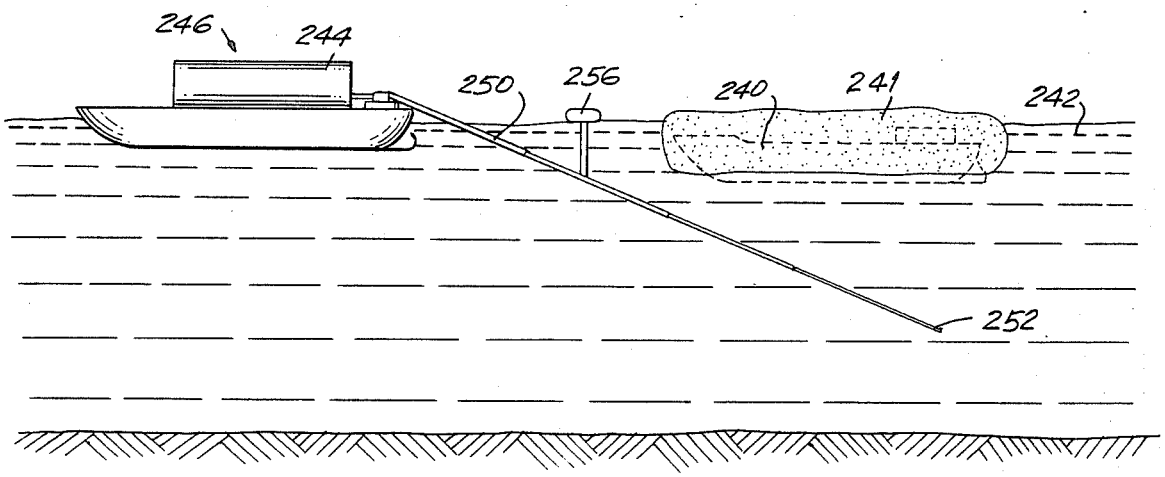
FIG. 22 shows cryogenic liquid being applied to the bottom of a raised iced vessel.
Figure 23:
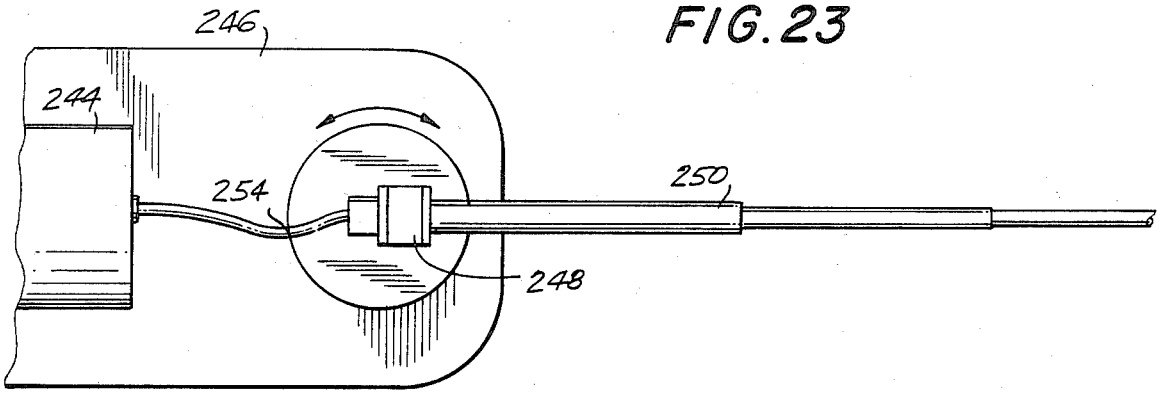
FIG. 23 shows a view of cryogenic piping attached to a rotatable mechanism on the fantail of the salvage vessel.

FIG. 22 schematically shows a raised vessel 240 enclosed in ice 241 near the surface 292 of the water having a liquefied cryogenic fluid, preferably nitrogen, applied to the area of the keel of vessel 240. The liquefied nitrogen is stored in a cryogenic container 244 on a salvage vessel 246. A swivable mounting 248, seen in FIG. 23, on the fantail of vessel 240 holds one end of a telescope-type cryogenic transfer pipe 250 that extends from the fantail to vessel 246 where an outlet port 252 directs the liquefied cryogenic fluid against the keel area of the vessel. Main cryogenic container 244 feeds transfer pipe 250 by way of a flexible connecting line 254. Outlet part 252 can be manuevered to different areas of the vessel by manipulation of swivel mounting 248 and telescoping action of transfer pipe 250. A balloon float 256 is attached by a line to pipe 250 to support the pipe at an angled position.

Figure 24:
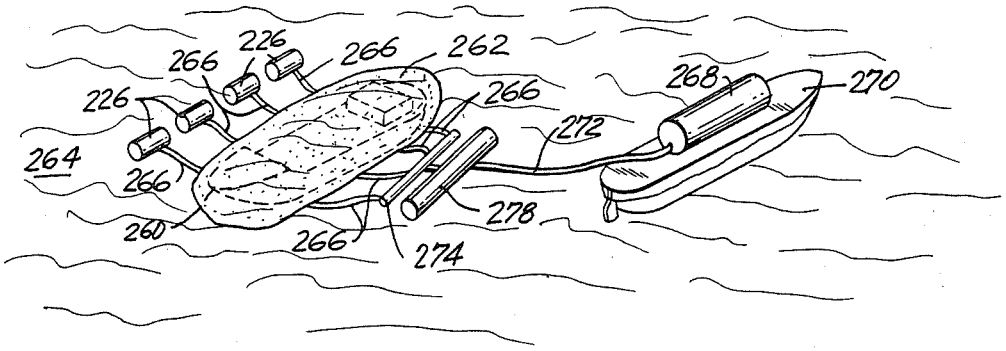
FIG. 24 is a view of refrigeration-type cryogenic piping positioned under a raised iced vessel.

Alternatively, as seen in perspective in FIG. 24, a raised vessel 260 encased in ice 262 on the surface of the sea 264 is provided with a parallel grouping of four flexible cryogenic pipes 266 that pass under the keel of the vessel. A main cryogenic container 268 mounted on a salvage vessel 270 is attached to a flexible transfer line 272 that feeds a header 274 that is turn feeds flexible pipes 266. Pipes 266 on the far side of vessel 260 from header 274 are held afloat by pontoons 276 while header 274 is held afloat by an elongated cylindrical pantoon 228. Pipes 266 are vented to allow escaped of cryogenic vapor (by means not shown).

The embodiments and methods of the present invention particularly disclosed herein are presented merely as examples of the invention. Other embodiments forms, modifications, and variations of the methods set forth here of this invention coming within the proper scope of the appended claims will, of course, readily suggest themselves to those skilled in the art.

What is claimed is:

1. A method for raising a sunken vessel lying at the bottom of a body of water, comprising the following steps:

positioning cryogenic means in relationship with said sunken vessel, said cryogenic means including a liquefied cryogenic fluid in the vicinity of the vessel for delivery of the fluid to the vessel, and distributing said fluid the length of the vessel within cryogenic piping held in close proximity to the vessel, and directing said fluid through cryogenic pipes of said piping which are shaped for delivering said fluid to the lower outside of the vessel that is close to the bottom's surface, with minimum penetration of said bottom surface, with releasing for vaporization, said liquefied cryogenic fluid around said sunken vessel along its length in sufficient quantity so that a sufficient volume of water is formed into an ice mass integral with and encapsulating a sufficient portion of the length of said sunken vessel so that the vessel is raised to the surface of the water by the force of the buoyancy of the ice.

2. A method according to claim 1 further comprising the steps of:

holding the liquefied cryogenic fluid in a main cryogenic container in a position above the surface of the water over said sunken vessel, and positioning a submerged cryogenic container proximately to said sunken vessel, and transfering said fluid by cryogenic piping to the submerged cryogenic container so that said sufficient quantity of fluid is available for essentially simultaneous uniform encapsulation along the said sufficient portion.

3. A method according to claim 2, wherein said cryogenic fluid is also directed through an inner cryogenic piping apparatus that is extended within said sunken vessel, without expelling the greater mass of water contained in the region into which it is extended, said inner piping apparatus being adapted to form the greater portion of the water within the vessel in the region in which it is extended, into ice within said sunken vessel and forming the ice mass within the vessel simultaneously with the said forming of the encapsulating ice mass outside the vessel so that the vessel is raised to the surface of the water by the force of the buoyancy of the total ice mass thus formed.

4. A method according to claim 2, wherein said submerged cryogenic container is held in a position above said sunken vessel by cables connected to a surface ship.

5. A method according to claim 2, wherein said submerged cryogenic container is directly attached to said sunken vessel by a magnetic appliance.

6. A method according to claim 2 wherein said submerged cryogenic container is filled with said liquefied cryogenic fluid at gravity pressure from said main cryogenic container and further comprising stabilizing said pressure at gravity level by filling a main vapor relief line running from said submerged cryogenic container to above the surface of the water, and filling a branch vapor relief line running from the said cryogenic piping to above the surface of the water.

7. A method according to claim 2 wherein said submerged cryogenic container is partially filled with said liquefied cryogenic fluid, which is at a pressure slightly above the atmospheric pressure, and further comprising pumping the fluid to the cryogenic piping with a pump in the submerged container, and stabilizing the pressure at slightly above atmospheric by venting the fluid through a main vapor relief line running from said submerged cryogenic container to above the surface of the water, and a branch vapor relief line running from the said cryogenic piping to above the surface of the water.

8. A method according to claim 2 further comprising releasing said liquefied cryogenic fluid into the water in proximity to said sunken vessel upon remote signal by actuating valve means in the cryogenic pipes.

9. A method according to claim 3 wherein said shaped piping includes rotatable piping capable of being moved into close proximity with the hull of said sunken vessel and rotating said shaped piping by remote control by transmission of a signal until said fluid is delivered to the lower outside of the vessel for the said encapsulating a sufficient portion of the length.

10. A method according to claim 7 further including controlling the rate of formation and the configuration of the ice mass encapsulating a sufficient portion of the length by directing the fluid through the said cryogenic piping means which are adapted to act as refrigeration coils, wherein the ice around the sunken vessel is built up slowly.

11. A method according to claim 1, wherein said cryogenic means includes a plurality of small cryogenic containers each containing said liquefied cryogenic fluid and further including the step of attaching said small cryogenic containers to said sunken vessel, said small cryogenic container including means for simultaneously ejecting said liquid cryogenic fluid into the water around said sunken vessel wherein said sunken vessel is encased in an ice mass, whereby said sunken vessel is raised to the surface of the water by force of the buoyancy of said ice mass.

12. A method according to claim 1, wherein said liquefied cryogenic fluid is liquefied nitrogen.

13. A method according to claim 1, further including the step of placing a wire net means around said cryogenic means and said vessel, said wire net means being for aiding in the positioning the ice mass in proximity to said sunken vessel during formation of the ice mass.

14. A system for raising a sunken vessel lying at the bottom of a body of water, comprising, in combination:

source of liquefied cryogenic fluid, cryogenic means positioned proximate said sunken vessel, and means for transferring, said liquefied cryogenic fluid from said source to said cryogenic means, said cryogenic means being for forming an ice mass integral with said sunken vessel upon receipt of said liquefied cryogenic fluid, whereby the sunken vessel is raised to the surface of the water by the force of the buoyancy of the ice, said cryogenic means comprising cryogenic piping held in close proximity to, and running substantially along the length of the vessel, and further comprising cryogenic pipes which are shaped for delivering said fluid along the length of the vessel and to the lower outside of the vessel that is close to the bottom's surface, with minimum penetration of said bottom surface, and said cryogenic means further comprising inner cryogenic piping apparatus extended within an inner space of the sunken vessel and adapted for delivering said fluid to the inner space, means for expelling vapor products of the fluid from the inner space adapted for expelling said vapor in a manner which the means will not expel the greater mass of the water contained in the region in which the inner cryogenic piping is extended, a sufficient quantity of fluid delivered by said cryogenic pipings to form the greater portion of water contained in the region in to which it is extended into ice, as well as a sufficient volume of water outside the vessel into an ice mass encapsulating a substantial portion of the length of the vessel, simultaneously so that the vessel is raised to the surface of the water by the force of the bouyancy of the total ice mass thus formed.

* * * * *